US006567074B2

(12) United States Patent
Numata et al.

(10) Patent No.: US 6,567,074 B2
(45) Date of Patent: May 20, 2003

(54) OPERATION APPARATUS USING OPERATING UNIT HAVING PLURAL PUSH-BUTTONS FORMED INTEGRALLY THEREWITH

(75) Inventors: Tetsu Numata, Fukushima-ken (JP); Toshio Furudate, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 119 days.

(21) Appl. No.: 09/918,222

(22) Filed: Jul. 30, 2001

(65) Prior Publication Data

US 2002/0015021 A1 Feb. 7, 2002

(30) Foreign Application Priority Data

Jul. 31, 2000 (JP) ..... 2000-230225

(51) Int. Cl.[7] ..... G09G 5/00
(52) U.S. Cl. ..... 345/169; 200/5 R; 463/37
(58) Field of Search ..... 345/156, 157, 345/158, 168, 169; 200/5 R, 6 R, 343; 463/37

(56) References Cited

U.S. PATENT DOCUMENTS 5,045,647 A * 9/1991 Kato ..... 200/5 E
5,430,262 A * 7/1995 Matsui et al. ..... 200/5 A
5,545,865 A * 8/1996 Gotou ..... 200/341
5,853,326 A 12/1998 Goto et al.
5,965,854 A * 10/1999 Umemura ..... 200/5 E
RE36,738 E * 6/2000 Matsumiya et al. ..... 200/6 A
6,096,985 A * 8/2000 Ritter et al. ..... 200/6 A
6,342,009 B1 * 1/2002 Soma ..... 463/38
6,348,664 B2 * 2/2002 Kozuma ..... 200/6 A
6,352,417 B1 * 3/2002 Soma et al. ..... 463/36

* cited by examiner

*Primary Examiner*—Richard Hjerpe
*Assistant Examiner*—M. Fatahiyar
(74) *Attorney, Agent, or Firm*—Brinks Hofer Gilson & Lione

(57) ABSTRACT

In an operating unit, push buttons are integrally formed via a connecting section, and the top face of the connecting section abuts the bottom face of a panel. On side-faces of the push buttons, an outwardly protruding flange is integrally formed. The top face of the flange is set to be at a position higher than that of the top face of the connecting section. When one of the push buttons is pressed down, the operating unit is rotated about a point in the inside of another of the push buttons as a fulcrum so as to turn on the output of a switch member. Because the operating unit is rotated about the inside point as the fulcrum, other switch members cannot be switched.

3 Claims, 5 Drawing Sheets

OPERATION APPARATUS USING OPERATING UNIT HAVING PLURAL PUSH-BUTTONS FORMED INTEGRALLY THEREWITH

BACKGROUND OF THE INVENTION

1. Field of the Invention

The present invention relates to push-button-type operation apparatuses for use in games, for example, and in particular relates to an operation apparatus using an operating unit having plural push-buttons formed integrally therewith.

2. Description of the Related Art

FIG. 4 is an assembly view of a conventional operation apparatus; FIGS. 5A and 5B are schematic representations of the operation, wherein FIG. 5A shows a state before operation and FIG. 5B shows a state during the operation.

An operation apparatus 50 shown in FIG. 4 is for use in a controller for game machines, for example. The operation apparatus 50 is provided with an operating unit 52, a switch member 53, and a supporter 56 arranged in a panel 51.

On the top surface of the panel 51, holes 51*a*, 51*b*, 51*c*, and 51*d*, which are divided into four sections, are formed in a cross-arrangement. The operating unit 52 is inserted into the holes 51*a*, 51*b*, 51*c*, and 51*d* from the backside of the panel 51. The operating unit 52 is integrally formed of four push buttons 52*a*, 52*b*, 52*c*, and 52*d* which protrude out of the holes 51*a*, 51*b*, 51*c*, and 51*d*, respectively. On the side of the operating unit 52, a flange 52*e* is integrally formed to protrude outwardly.

Underneath the operating unit 52, a supporter 56 is provided, and a switch member 53 is further arranged underneath the supporter 56.

The switch member 53 comprises an elastic member 54 and a circuit board 55. On the top surface of the elastic member 54, elastically deformable projections to be pressed 54*a*, 54*b*, 54*c*, and 54*d* are formed at positions opposing the push buttons 52*a*, 52*b*, 52*c*, and 52*d*, respectively. On the backsides of the projections to be pressed 54*a*, 54*b*, 54*c*, and 54*d*, conductive members 57*a* and 57*c* are provided. On the other hand, on the circuit board 55, electrodes 55*a* and 55*c* are formed at positions opposing the conductive members 57*a* and 57*c*, respectively. Each of the electrodes 55*a* and 55*c* is formed of two semi-circular electrodes opposing each other at a predetermined interval therebetween (see FIG. 4 and FIGS. 5A and 5B). In addition, although conductive members of the projections to be pressed 54*b* and 54*d* are not shown, they are arranged to respectively oppose the conductive members 57*a* and 57*c* just like the conductive members 57*a* and 57*c*.

In the operation apparatus 50 described above, when the push button 52*a* is pressed down, for example, the conductive member 57*a* is brought into contact with the electrode 55*a*. Thereby, one semi-circular electrode is connected to the other so that the switch is turned on.

In the operation apparatus 50, however, during non-operation, as shown in FIG. 5A, the operating unit 52 is raised upwardly by spring-return forces of the projections to be pressed 54*a*, 54*b*, 54*c*, and 54*d*. Then, when the push button 52*a* is pressed down after the non-operation state, as shown in FIG. 5B, there has been a problem that despite of the push button 52*a* being only pressed down, other push buttons such as the push button 52*c* or 52*d* may be simultaneously pressed down so that the switch is turned on. Such movement results in a malfunction and a mistake in the operation, which damage operationality.

That is, in the operation apparatus 50 shown in FIGS. 5A and 5B, when the push button 52*a* is pressed down, the operating unit 52 is inclined about a point P as a fulcrum in the flange 52*e* formed in the side of the push button 52*b* opposing the push button 52*a*. Because in the inclination, the point P as the fulcrum is located mostly apart from the push button 52*a*, the push buttons 52*c* and 52*d* are positioned in the intermediate between the push buttons 52*a* and 52*b*, so that the downward displacement thereof is large. Therefore, the switches of the push buttons 52*c* and 52*d* may be turned on by mistake although they are not operated.

Also, when the push button 52*a* is pressed down, a pressing load is generated between the conductive member 57*a* and the electrode 55*a*, which is increased by pressing loads added thereto due to the push buttons 52*c* and 52*d* which are not pressed, resulting in a defect of the damaged operational touch.

SUMMARY OF THE INVENTION

In order to solve the problems described above, it is an object of the present invention to provide an operation apparatus capable of pushing a push button without turning on another switch of another push button which is not operated and moreover being capable of reducing a pressing load during pushing down a push button.

It is also an object of the present invention to provide an operation apparatus suitable for a switch member capable of outputting in an analog fashion.

An operation apparatus according to the present invention comprises a first and a second pressing operation element whose output is changed by a pressing operation, a third pressing operation element disposed at an intermediate position between the first and the second pressing operation element, which is off the line connecting the first and the second pressing operation element, an operating unit which presses the first pressing operation element when the operating unit is inclined in a first direction and presses the second pressing operation element when the operating unit is inclined in a second direction opposite to the first direction, the operating unit pressing the third pressing operation element when the operating unit is inclined in a third direction which is different from the first and the second direction, push buttons disposed in the operating unit for applying a pressing force for inclining the operating unit in each of the directions, and a supporting portion for supporting the top surface of the operating unit, on which the push buttons are arranged, at a position inside the push buttons, wherein the operating unit can be inclined in each of the directions, using the point on which the supporting portion abuts as a fulcrum.

An apparatus according to the present invention may further comprise a fourth pressing operation element disposed opposite the third pressing operation element and interposing the line connecting the first and the second pressing operation element therebetween, wherein the fourth pressing operation element may be pressed when the operating unit is inclined in a fourth direction opposite the third direction using the point on which the supporting portion abuts as a fulcrum.

According to the present invention, because the operating unit is inclined using the inside part of the push buttons of the operating unit as a fulcrum when the first pressing operation element is pressed or when the second pressing operation element is pressed, the pressing amount of the third pressing operation element or the fourth pressing operation element is reduced, so that the output of the third or the fourth pressing operation element cannot be changed by mistake.

For example, holes may be independently formed on a panel so that each of the push buttons protrudes therefrom, and the intermediate portion of the holes on the panel is the supporting portion.

In this case, the inside of the panel may be provided with a substrate for supporting the pressing operation elements, and the operating unit may be sandwiched between the panel and the substrate so as to be supported.

Furthermore, according to the present invention, the outer periphery of the operating unit may be provided with a flange opposing the gap between the push buttons and the holes from the inside of the panel, and the flange may be formed at a position which is set such that it does not come into contact with the panel when the operating unit is inclined.

Because the flange fills up the gap between the push buttons and the holes, the mechanism inside the panel is invisible through the gap. The flange does not act as a fulcrum for the inclination of the operating unit, so that the operating unit cannot be largely inclined such that it does not cause a malfunction of the other pressing operation elements with no resemblance to a conventional unit.

According to the present invention described above, a pressing operation element opposing another push button, which is not operated during the push button operation, can be prevented from being operated by mistake, and moreover the pressing load during pushing down a push button can be reduced.

BRIEF DESCRIPTION OF THE DRAWINGS

FIGS. 3A and 3B are schematic representations of the operation apparatus according to the present invention, wherein FIG. 3A shows a state before operation and FIG. 3B shows a state during the operation;

FIGS. 5A and 5B are schematic representations of the conventional operation apparatus, wherein FIG. 5A shows a state before operation and FIG. 5B shows a state during the operation.

DESCRIPTION OF THE PREFERRED EMBODIMENTS

Figure 1:
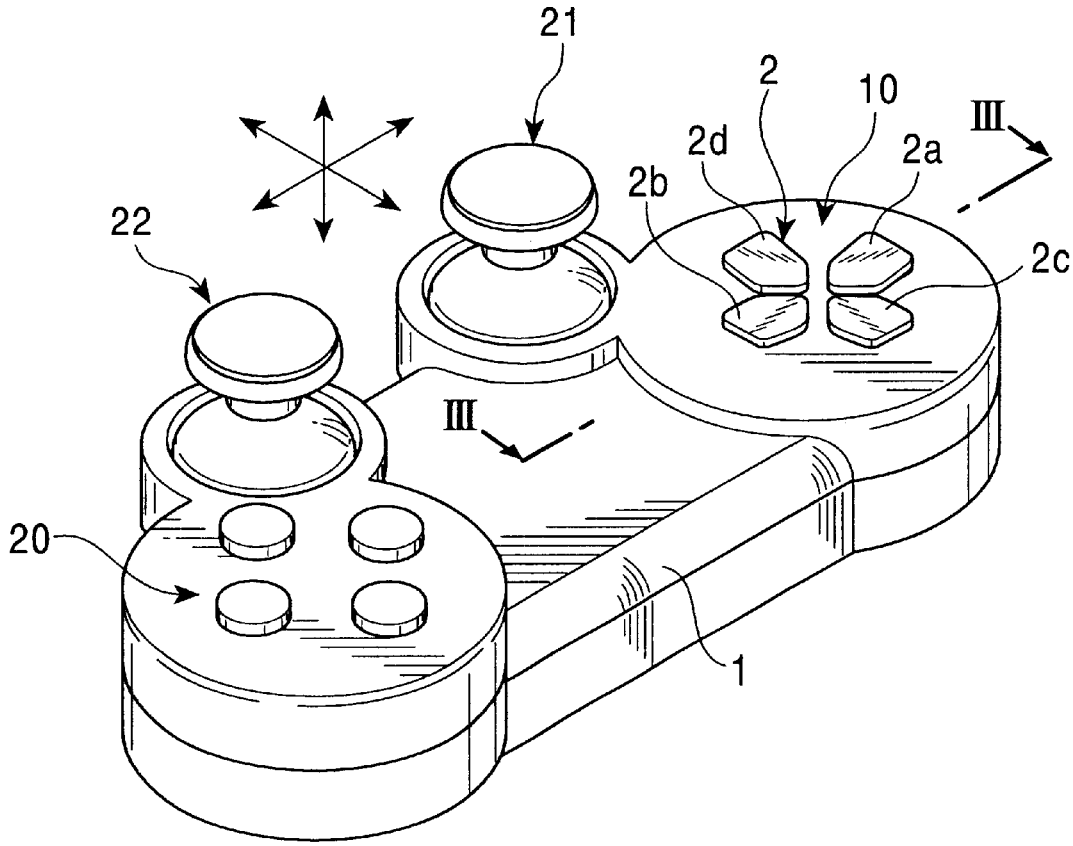
FIG. 1 is a perspective view of an operation apparatus according to an embodiment of the present invention.
Figure 2:
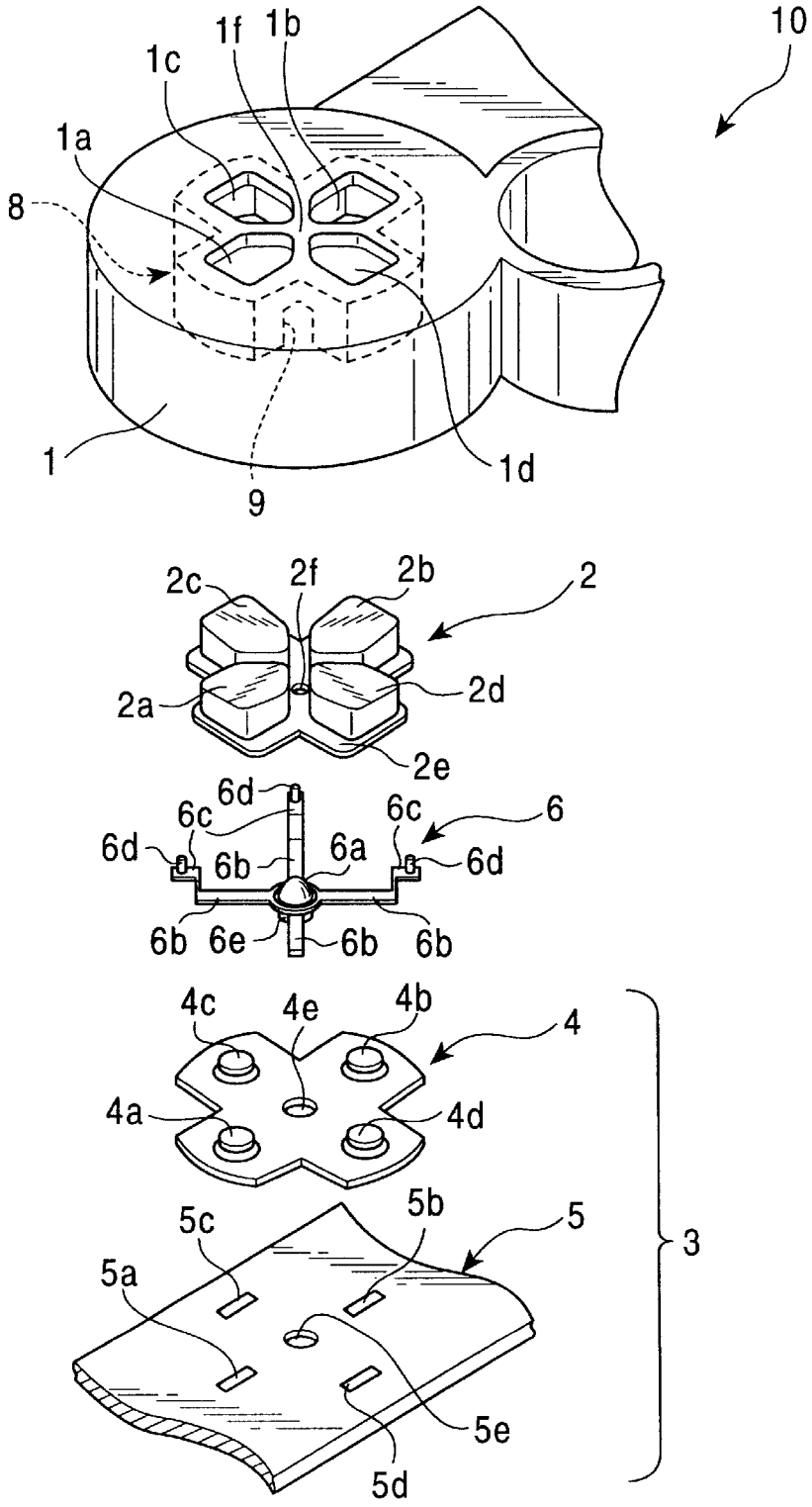
FIG. 2 is an assembly view of the operation apparatus according to the present invention.
Figure 3A:
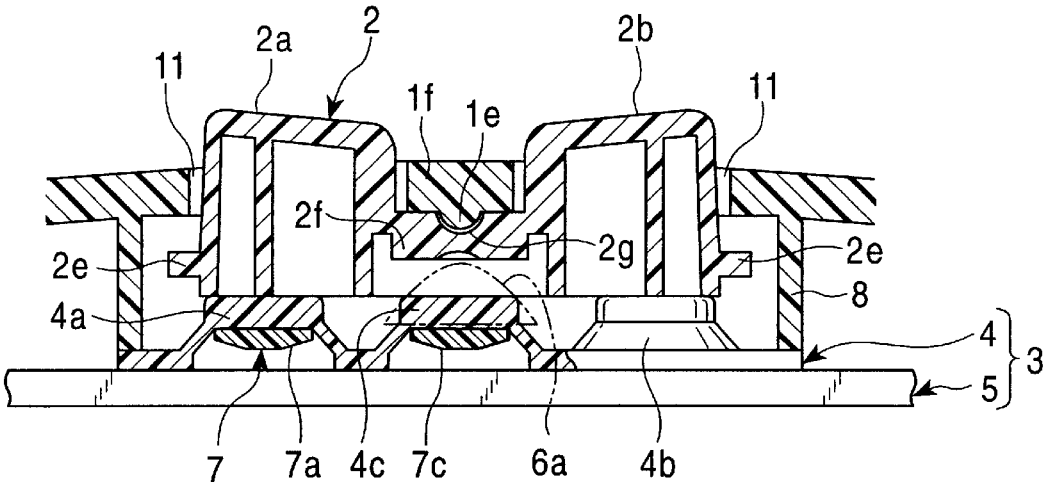
Figure 3B:
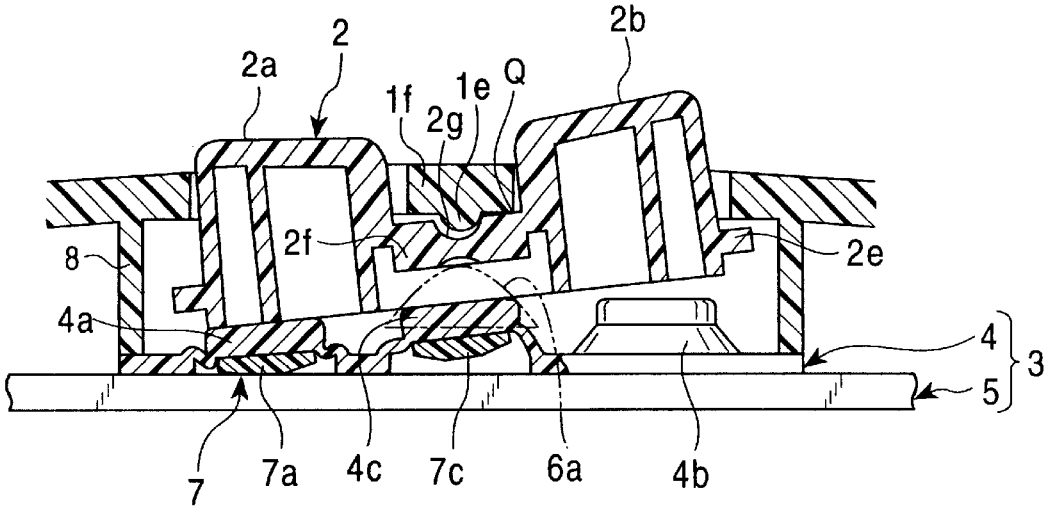
Figure 4:
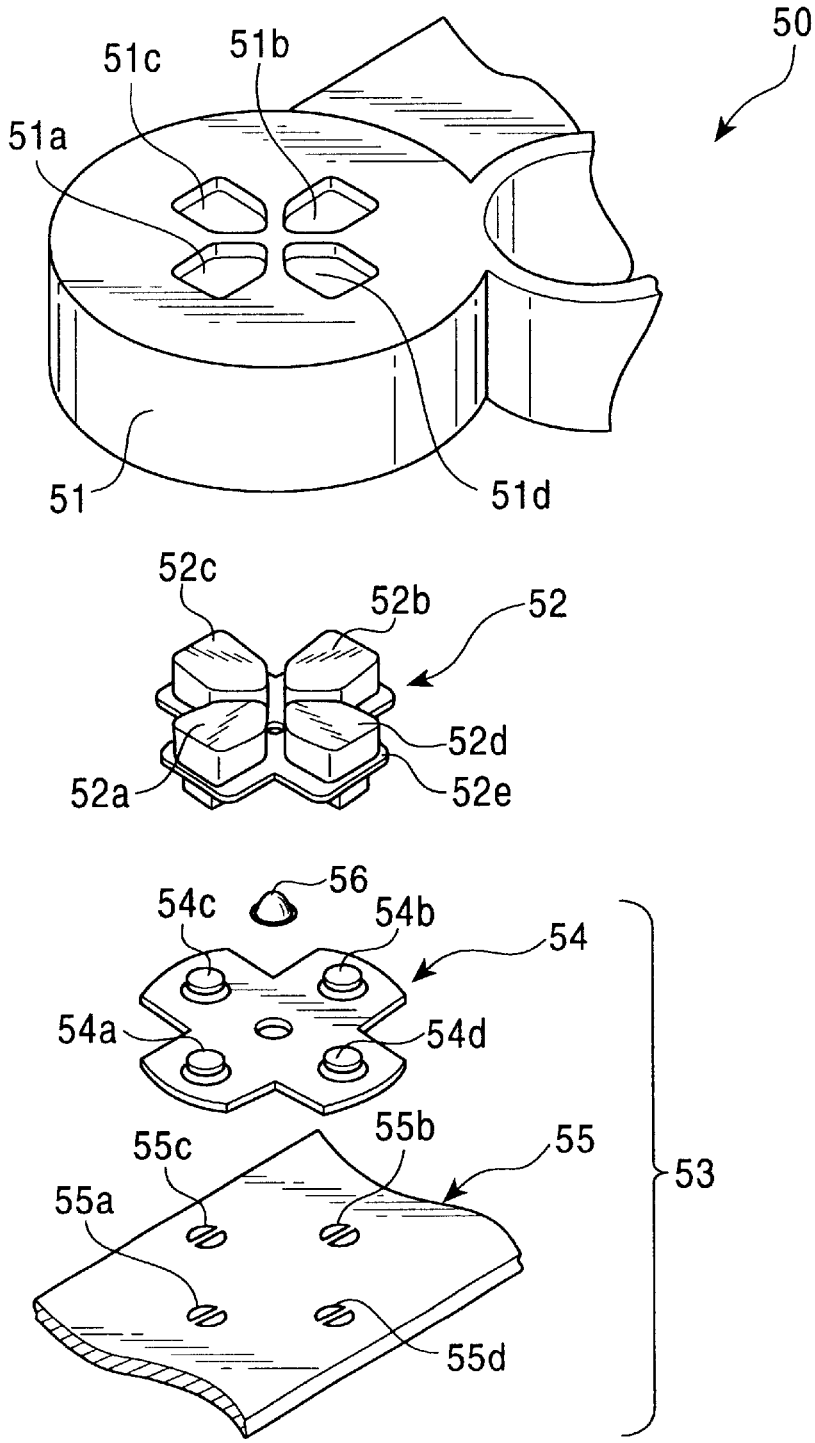
FIG. 4 PRIOR ART
FIG. 4 is an assembly view of a conventional operation apparatus.
Figure 5A:
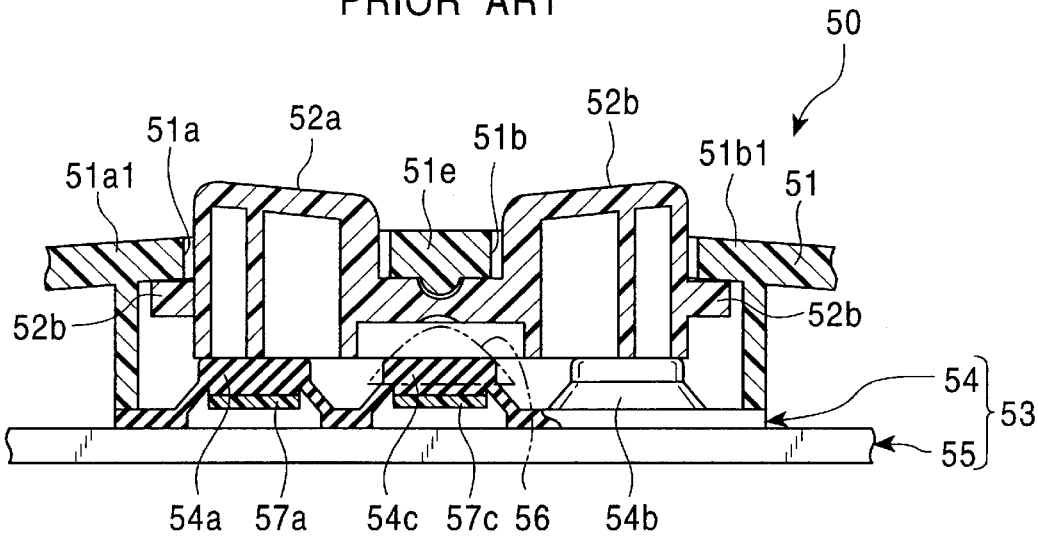
FIG. 5A PRIOR ART
Figure 5B:
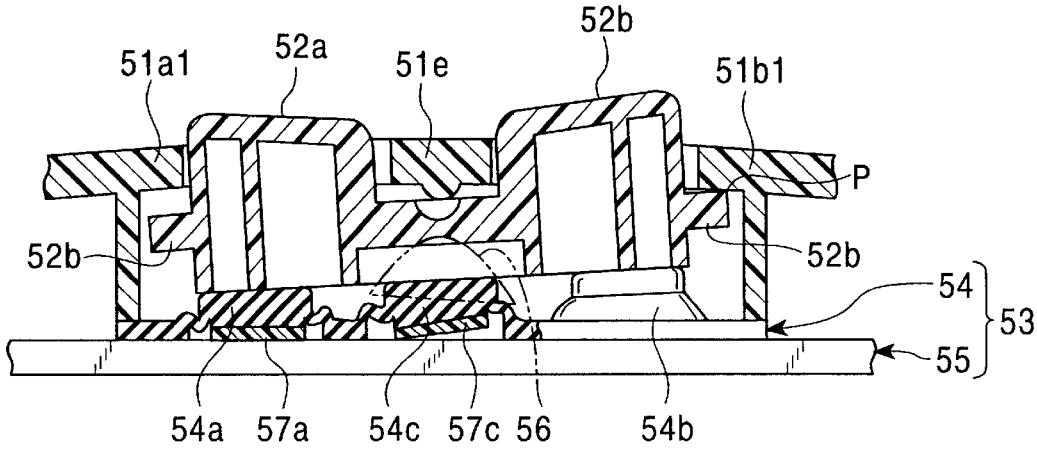
FIG. 5B PRIOR ART

FIG. 1 is a perspective view of an operation apparatus according to an embodiment of the present invention; FIG. 2 is an assembly view thereof; and FIGS. 3A and 3B are operational schematic representations, wherein FIG. 3A shows a state before operation and FIG. 3B shows a state during the operation.

An operation apparatus 10 shown in FIG. 1 is for use in a pad-type controller for game machines by being assembled therein. The operation apparatus 10 is mounted within a panel 1 which is further provided with another push-button-type operating unit 20 and operating units 21 and 22 capable of inputting in a stick-type analogue fashion formed therein. The operation apparatus 10 may be used as a directional key so as to move characters and a cursor, for example.

On the top surface of the panel 1, holes 1*a*, 1*b*, 1*c*, and 1*d* are independently formed to define four holes, which adjoin with each other, and each twists its direction at 90° intervals so as to be formed in a cross-arrangement. On the bottom surface of the panel 1, a cross-shaped wall 8 extending downwardly is formed around the holes 1*a*, 1*b*, 1*c*, and 1*d* to enclose them. In corners of the wall 8, cut-outs 9 are upwardly formed from the bottom end to intermediate portions. In addition, although only one of the cut-outs 9 is shown in the drawing, the same cut-outs are formed in the other corners. Furthermore, in the center of the bottom surface of the panel 1 surrounded by the holes 1*a*, 1*b*, 1*c*, and 1*d*, a hemispherical small projection 1*e* is formed. The region of the panel 1 inside the holes 1*a*, 1*b*, 1*c*, and 1*d* is a supporting portion 1*f* which is the fulcrum for the inclination movement of the operating unit 2.

On the top surface of the operating unit 2, four block-like push buttons 2*a*, 2*b*, 2*c*, and 2*d* are formed at intervals therebetween, and a connecting section 2*f* is formed in the central part of the push buttons. On the top face of the connecting section 2*f*, a hemispherical concave portion 2*g* is formed. On the side of the push buttons 2*a*, 2*b*, 2*c*, and 2*d*, an outwardly protruding flange 2*e* is integrally formed. The top face of the flange 2*e*, as shown in FIGS. 3A and 3B, is formed at a level higher than that of the top face of the connecting section 2*f* while the position of the flange 2*e* is set such that it does not come into contact with the internal part of the panel 1 when the operating unit 2 is operated.

On the bottom face of the operating unit 2, a supporter 6 is provided. The supporter 6 is provided with a substantially conical projection 6*a* which is formed at the center of the supporter 6 so as to upwardly protrude. On the bottom face of the projection 6*a*, a downwardly protruding cylinder 6*e* is formed integrally therewith. Furthermore, the projection 6*a* is provided with arms 6*b*, 6*b*, 6*b*, and 6*b* integrally formed so as to extend outside thereof. Each of the arms 6*b*, 6*b*, 6*b*, and 6*b* twists its direction at 90° intervals. Three arms 6*b*, 6*b*, and 6*b* thereof are provided with folded parts 6*c*, 6*c*, and 6*c* upwardly formed at ends of the arms. At ends of the folded parts 6*c*, 6*c*, and 6*c*, retaining projections 6*d*, 6*d*, and 6*d* are further formed upwardly.

On the lower side of the supporter 6, a switch member 3 is arranged, which comprises an elastic member 4 and a circuit board 5.

The elastic member 4 is cross-like formed and made of rubber or a resin, etc., so as to be elastically deformable. On the top face of the elastic member 4, projections to be pressed 4*a*, 4*b*, 4*c*, and 4*d* are protrudently formed, which are formed at positions respectively opposing the push buttons 2*a*, 2*b*, 2*c*, and 2*d*. At the center of the elastic member 4, a through-hole 4*e* is formed.

The projections to be pressed 4*a*, 4*b*, 4*c*, and 4*d*, as shown in FIGS. 3A and 3B, are conically formed to have each space inside. On the ceiling faces of the spaces, elastic resistors 7*a* and 7*c* with small specific resistance are arranged, respectively. In addition, although not shown, the projections to be pressed 4*b* and 4*d* are provided with the same elastic resistors, which are called as elastic resistors 7 together with the elastic resistors 7*a* and 7*c*.

The substantially conical-shaped elastic resistor 7 is made by mixing an elastic member such as rubber with a conductive member such as carbon to have a specific resistance smaller than those of resistors 5*a*, 5*b*, 5*c*, and 5*d*, which will be described later. As the shape of the elastic resistor 7 shown in the drawing, the tip is cut-off to have a flat end; however, the end may be acute-angled.

On the other hand, the circuit board 5 is made by joining a film-like substrate to a glass-fiber-reinforced epoxy or metallic plate, and has a pattern formed on the top face and comprising the rectangular resistors 5*a*, 5*b*, 5*c*, and 5*d* having large resistance. The resistors 5*a*, 5*b*, 5*c*, and 5*d* are arranged at positions respectively facing the elastic resistors 7. The elastic resistors 7 can be brought into and out of contact with the resistors 5*a*, 5*b*, 5*c*, and 5*d*. On the circuit board 5, a circular through-hole 5*e* is also formed.

In the embodiment, a first pressing operation element is formed of the resistor 5*a* and the elastic resistor 7 opposing the resistor 5*a*, and a second, a third, and a fourth pressing operation element are formed of the resistor 5*b* and the elastic resistor 7, the resistor 5*c* and the elastic resistor 7, and the resistor 5*d* and the elastic resistor 7, respectively. The pressing operation elements respectively formed of the resistors 5*a*, 5*b*, 5*c*, and 5*d* and the elastic resistors 7 are crosswise arranged just like the push buttons 2*a*, 2*b*, 2*c*, and 2*d*. That is, the third and the fourth pressing operation element are not located on the line connecting between the first pressing operation element having the resistor 5*a* and the second pressing operation element having the resistor 5*b*, so that the line connecting between the third and the fourth pressing operation element is perpendicularly arranged to the line connecting between the first and the second pressing operation element.

In the operation apparatus 10, the operating unit 2 is firstly inserted from the bottom side of the panel 1 until the top face of the connecting section 2*f* abuts the bottom face of the panel 1 using the wall 8 as a guide. Thereby, the top faces of the push buttons 2*a*, 2*b*, 2*c*, and 2*d* become a state of protruding by a predetermined length out of the holes 1*a*, 1*b*, 1*c*, and 1*d* of the panel 1. At this time, the concave portion 2*g* of the operating unit 2 and the small projection 1*e* of the panel 1 are fitted with each other, so that the operating unit 2 is positioned such that it does not deviate laterally in the panel 1.

When the supporter 6 is further attached to the bottom side of the operating unit 2, the projection 6*a* abuts the bottom face of the operating unit 2, while the arms 6*b*, 6*b*, 6*b*, and 6*b* are respectively fitted into the cut-outs 9 in the corners of the wall 8. The retaining projections 6*d*, 6*d*, and 6*d* are further abutted to the respective side-faces of the wall 8 to restrict the lateral movement of the supporter 6. Thereby, the positional deviation of the supporter 6 is prevented. Due to the arms 6*b*, 6*b*, 6*b*, and 6*b*, the projection 6*a* is prevented from toppling when the supporter 6 is placed on the switch member 3.

Furthermore, the bottom side of the supporter 6 is provided with the switch member 3 comprising the elastic member 4 and the circuit board 5. The cylinder 6*e* formed in the supporter 6 is inserted into the through-hole 4*e* formed in the elastic member 4 and is further inserted into the through-hole 5*e* formed on the circuit board 5.

Next, operation of the operation apparatus 10 will be described with reference to FIGS. 2, 3A, and 3B. In addition, FIGS. 3A and 3B are sectional views cut-away at the line connecting between the push button 2*a* and the push button 2*b*, i.e., at the line 3—3 of FIG. 1.

When none of the push buttons 2*a*, 2*b*, 2*c*, and 2*d* is operated, as shown in FIG. 3A, the operating unit 2 is held as raised upwardly due to an elastic force of the projections to be pressed 4*a*, 4*b*, 4*c*, and 4*d* of the elastic member 4. At this time, the top face of the connecting section 2*f* of the operating unit 2 is abutted to the bottom face of the supporting portion 1*f* (the intermediate part between the holes 1*a*, 1*b*, 1*c*, and 1*d*) of the panel 1. Accordingly, the elastic resistors 7 are not brought into contact with the resistors 5*a*, 5*b*, 5*c*, and 5*d*, respectively, so that the output of each pressing operation element is held off.

When the push button 2*a* is pushed down from the state mentioned above, as shown in FIG. 3B, the operating unit 2 is rotated in a first direction, i.e., the downward direction of the push button 2*a* and the upward direction of the push button 2*b*, using a point Q inside the push button 2*b*, that is, a corner of the supporting portion 1*f* located inside the hole 1*b*, as a fulcrum. At this time, the flange 2*e* on the side-face of the push button 2*b* is set to have a height so that it is not brought into contact with any position inside the panel 1. Therefore, the pressing load is not increased with no similarity to a conventional operation apparatus in which the rotation is restricted by the projection 6*a* of the supporter 6 and the flange 2*e*.

When the push button 2*a* is downwardly pressed as described above, the projection to be pressed 4*a* is pressed due to the pressing force. At this time, the inclined part of the projection to be pressed 4*a* is elastically deformed so that the elastic resistor 7*a* is downwardly moved. The elastic resistor 7*a* is thereby brought into contact with the resistor 5*a* disposed on the circuit board 5. In the pressing operation element, the contact area between the elastic resistor 7*a* and the resistor 5*a* varies with the pressing amount. Because the specific resistance of the elastic resistor 7*a* is smaller than that of the resistor 5*a*, the resistance across both sides of the resistor 5*a* is changed according to the contact area mentioned above, so that an output signal in an analogue fashion can be obtained.

When the operating unit 2 is inclined as shown in FIG. 3B, the fulcrum for the inclination is positioned at the point Q in the corner of the supporting portion if located inside the push buttons 2*a* and 2*b*, so that the push button 2*c* located in a direction perpendicular to the push button 2*a* cannot largely move downwardly. Thereby, the elastic resistor 7*c* cannot be brought into contact with the resistor 5*c* by the push button 2*c*, and similarly, the elastic resistor 7 disposed in the side of the push button 2*d* also cannot be brought into contact with the resistor 5*d*.

When the push button 2*b* is pressed, the operating unit 2 is inclined in a second direction opposite the direction shown in FIG. 3B, so that the elastic resistor 7 and the resistor 5*b* of a second pressing operation element are abutted to each other. At this time, however, a third pressing operation element comprising the resistor 5*c* and a fourth pressing operation element comprising the resistor 5*d* cannot be operated.

In contrast, also when the operating unit 2 is inclined in a third direction by pushing the push button 2*c* so as to activate the third pressing operation element, or when the operating unit 2 is inclined in a fourth direction by pushing the push button 2*d* so as to activate the fourth pressing operation element, the first and the second pressing operation element which are located in directions perpendicular to the directions of the third and the fourth pressing operation element cannot be operated because the operating unit 2 is inclined using the supporting portion 1*f* located in the intermediate between the hole 1*a*, 1*b*, 1*c*, and 1*d* as a fulcrum.

Because the fulcrum for the inclination of the operating unit 2 is located inside the push buttons as described above, the operating unit 2 itself does not sink largely when it is inclined in each direction with no resemblance to a conventional one, thereby preventing the pressing operation element, which is not to be operated, from being operated by mistake.

In addition, an operation apparatus according to the present invention is not limited to the embodiment described above; the pressing operation element may be only an on-off switching member. The supporting portion 1*f* for supporting the inside part of the push buttons 2*a*, 2*b*, 2*c*, and 2*d* in the operating unit 2 is not necessarily integrated with the panel 1; it may be formed independently of the panel 1.

What is claimed is:

1. An operation apparatus comprising:

a first and a second pressing operation element whose output is changed by a pressing operation;

a third pressing operation element disposed at an intermediate position between the first and the second pressing operation element, the third pressing operation element offset from a line connecting between the first and the second pressing operation element;

an operating unit which presses the first pressing operation element when the operating unit is inclined in a first direction and presses the second pressing operation element when the operating unit is inclined in a second direction apposite the first direction, the operating unit pressing the third pressing operation element when the operating unit is inclined in a third direction which is different from the first and the second direction;

push buttons disposed in the operating unit to apply a pressing force that inclines the operating unit in each of the directions; and a panel on which holes are independently formed such that each of the push buttons protrudes therefrom, a supporting portion to support a top surface of the operating unit, on which the push buttons are arranged, at a position between the push buttons, wherein the operating unit can be inclined in each of the directions, using a point on which the supporting portion abuts as a fulcrum;

wherein an intermediate portion of the panel disposed between the holes on the panel is the supporting portion, and wherein an outer periphery of the operating unit is provided with a flange opposing a gap between the push buttons and the holes from an inside of the panel, the flange being formed at a position which is set such that the flange does not come into contact with the panel when the operating unit is inclined.

2. An apparatus according to claim 1, further comprising a fourth pressing operation element disposed opposite the third pressing operation element and interposing the line connecting the first and the second pressing operation element therebetween, wherein the fourth pressing operation element is pressed when the operating unit is inclined in a fourth direction opposite the third direction using the point on which the supporting portion abuts as the fulcrum.

3. An apparatus according to claim 1, further comprising a substrate disposed inside the panel to support the pressing operation elements, wherein the operating unit is sandwiched between the panel and the substrate so as to be supported.

* * * * *

UNITED STATES PATENT AND TRADEMARK OFFICE

CERTIFICATE OF CORRECTION

PATENT NO. : 6,567,074 B2
DATED : May 20, 2003
INVENTOR(S) : Tetsu Numata et al.

It is certified that error appears in the above-identified patent and that said Letters Patent is hereby corrected as shown below:

Title page,
Item [56], References Cited, U.S. PATENT DOCUMENTS, delete "6,352,417" and substitute -- 6,352,477 -- in its place.

Signed and Sealed this

Seventh Day of October, 2003

JAMES E. ROGAN
*Director of the United States Patent and Trademark Office*